United States Patent [19]

Gregory

[11] Patent Number: 4,864,761

[45] Date of Patent: Sep. 12, 1989

[54] BARREL VIBRATION DAMPENING DEVICE FOR RIFLES

[76] Inventor: Jimmie E. Gregory, 1215 Bryden Ave., Lewiston, Id. 83501

[21] Appl. No.: 87,462

[22] Filed: Aug. 18, 1987

[51] Int. Cl.[4] ..... F41C 27/00

[52] U.S. Cl. ..... 42/75.01

[58] Field of Search ..... 42/75.01, 85

[56] References Cited

U.S. PATENT DOCUMENTS

| | | | |
|---|---|---|---|
| 1,355,419 | 10/1920 | Pedersen | 42/75.01 |
| 1,370,118 | 3/1921 | Johnson | 42/75.01 |
| 1,834,410 | 1/1931 | Loomis | 42/75.01 |
| 2,479,594 | 8/1949 | Yasho | 42/75.01 |
| 2,497,861 | 9/1950 | Brown, Jr. | 42/75.01 |
| 2,589,912 | 8/1952 | Weld | 42/75.01 |
| 2,696,059 | 5/1954 | Judd | 42/85 |
| 2,841,909 | 7/1958 | Temple | 42/75.01 |
| 3,060,612 | 10/1962 | Brown et al. | 42/75.01 |
| 3,387,538 | 9/1968 | Browning | 89/177 |
| 3,550,300 | 7/1970 | Roder . | |
| 3,955,299 | 5/1976 | Bullis | 42/75.01 |
| 4,057,924 | 11/1977 | Joseph | 42/75.01 |
| 4,195,432 | 4/1980 | Hickman | 42/100 |

*Primary Examiner*—Charles T. Jordan
*Assistant Examiner*—R. L. Klein
*Attorney, Agent, or Firm*—Wells, St. John & Roberts

[57] ABSTRACT

A vibration dampening device 10 is provided in the forearm 14 of a rifle 10 for engaging a cantilevered barrel 12 forward of the rifle action for dampening the vibration of the barrel as a bullet moves through the barrel to the muzzle. The vibration dampening device in the preferred embodiment includes an insert 44 that is mounted in a cavity 38 formed in the forearm 14. The insert includes a threaded bore 48 with a pressure screw 50 threadably mounted in the bore 48 in which the threaded screw has a pointed end 54 engaging the barrel at a selected point. A tool access aperture 58 extends through the forearm from the lower profile surface 16 in alignment with the threaded bore 48 for enabling a tool to be inserted through a tool access aperture 58 to engage the pressure screw 50 to rotate the pressure screw to the desired position. Preferably a locking means 60 is provided for locking the pressure screw 60 in place when the correct pressure is obtained.

10 Claims, 1 Drawing Sheet

BARREL VIBRATION DAMPENING DEVICE FOR RIFLES

TECHNICAL FIELD

This invention relates to rifles and more particularly to barrel vibration dampening devices for rifles.

Background of the Invention

It has been known for many years that the accuracy of a target rifle, particularly a bolt action target rifle, could be increased by contacting the barrel at a support point along the length of the barrel. Most bolt action barrels are cantilevered with the barrel portion being unsupported with respect to a forearm of the stock. It has been found that if the barrel is snuggly supported by the forestock that the accuracy of the barrel changes dramatically depending upon the temperature and humidity. It has been found that it is advisable to not support the forward portion of the barrel with respect to the forestock, but to provide clearance between the barrel and the forestock to prevent undue pressures on the barrel due to changes in humidity and temperature.

It is well known that the rifle stock forearms are subject to warpage due to changes in the weather or due to seasoning which occurs after the stock is finished and becomes part of the rifle. Changes which occur in a rifle stock effect changes in accuracy and also change the point of impact at which bullets strike a target with a given sight setting and holding of the rifle. Consequently, it was well known that the engagement or stressed relationship of a rifle barrel and forearm greatly impact the accuracy of the rifle and its ability to deliver a plurality of projectiles into a small group of a target.

It has been theorized that when the firearm is discharged, the barrel vibrates before the projectile or bullet leaves the muzzle. However, the manner in which the barrel vibrates for a given ammunition loading is largely dependent upon the location of the point of contact between the metallic barrel and action and the forestock as well as the pressure exerted by the point or points of contact upon the barrel and action.

Several patents are directed to providing a specific support point of contact along the cantilevered barrel to dampen the vibration. Exemplary of such devices are shown in U.S. Pat. Nos. 2,497,861; 2,479,594; 2,589,912; and 3,060,612.

One of the principal objects of this invention is to provide a barrel dampening device for rifles particularly bolt action rifles having a cantilevered barrel for efficiently and accurately contacting and supporting the barrel spaced forward of the action to efficiently dampen the vibration of the barrel during firing to increase the accuracy of the rifle, particularly when used for target shooting.

These and other advantages of this invention will become apparent upon reading the following detailed description of a preferred embodiment.

BRIEF DESCRIPTION OF THE DRAWINGS

The preferred and alternate embodiments of the invention are illustrated in the accompanying drawings, in which.

DETAILED DESCRIPTION OF THE PREFERRED AND ALTERNATE EMBODIMENTS

Figure 1:
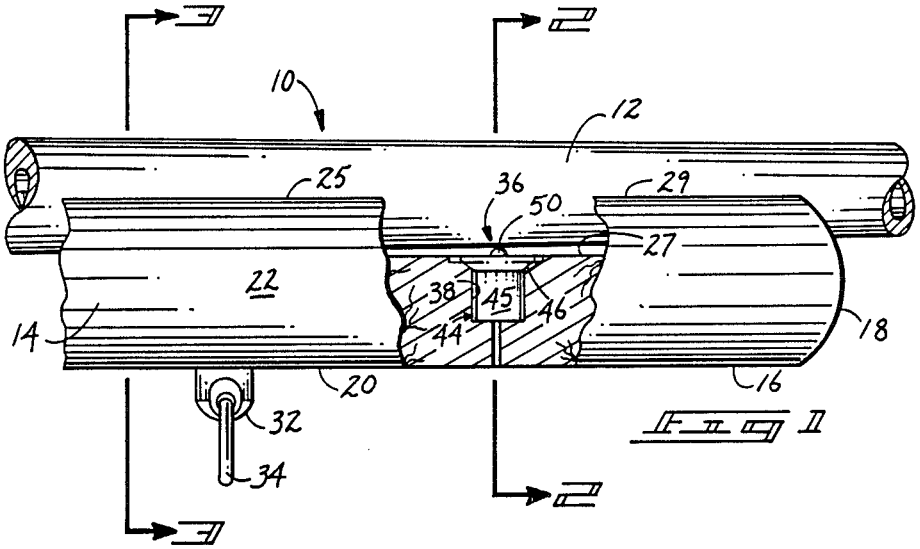
FIG. 1 is a fragmentary side view of a portion of a rifle showing a cantilevered barrel with respect to the forestock of the barrel illustrating a preferred embodiment of this invention for contacting the barrel forward from the rifle action.
Figure 3:
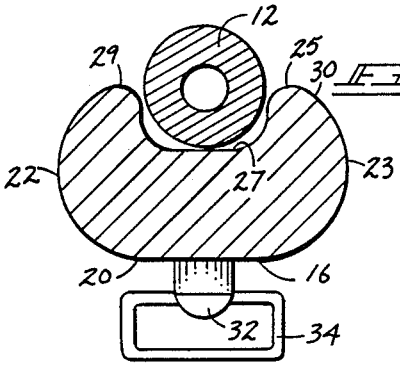
FIG. 3 is a cross-sectional view taken along line 3—3 in FIG. 1 illustrating a traditional rifle sling anchor.

The following disclosure of the invention is submitted in compliance with the constitutional purpose of the Patent Laws "to promote the progress of science and useful arts" (Article 1, Section 8).

This invention is related to a rifle and particularly to a bolt action rifle generally designated with the numeral 10 having a barrel 12 extending forward from the rifle action. The barrel has a longitudinal axis between the action and the muzzle. The rifle has a stock with a forearm 14 that extends forward beneath the barrel.

In a preferred embodiment, the barrel 12 is normally unsupported forward of the action with the barrel being cantilevered and untouched by the forearm 14. Preferably, the forearm 14 is made of wood and extends forward to a forearm end 18. The forearm 14 has a lower profile surface 16 that has an under surface 20 with side surfaces 22 and 23. Additionally, the forearm 14 has an upper profile surface 25 with a groove 27 formed therein along the length thereof forming side ridges 29 and 30.

Preferably the rifle has a rifle sling (not shown) that is attached to a rifle sling anchor 32 that is anchored in the under surface 20 of the forearm as illustrated in FIG. 1. The rifle sling stud 32 includes a rifle sling ring clip 34 that receives one end of the rifle sling to enable the rifleman to easily carry the rifle when the rifle is being carried.

Figure 2:
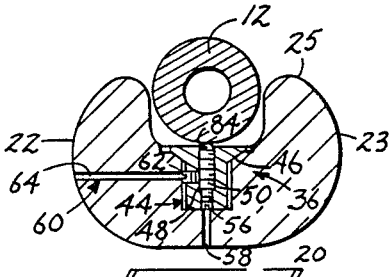
FIG. 2 is a cross-sectional view taken along line 2—2 in FIG. 1 illustrating the vibration dampening device illustrated in FIG. 1.

The rifle 10 as a vibration dampening device generally designated with the numeral 36 for engaging the barrel at a specific point along the barrel to minimize the vibration of the barrel and thereby improve the accuracy of the rifle. The vibration dampening device 36 is mounted in a cavity 38 that is formed in the forearm having an opening into the groove 27 beneath the barrel 12. The cavity 38 has a base wall and a cylindrical side wall with an axis that extends upward normal to the barrel 12. In the preferred embodiment illustrated in FIGS. 1 and 2, the cavity 38 has a beveled counter bore forming a conical surface at the opening of the cavity.

The vibration dampening device 36 includes an insert 44 with a cylindrical body 45 that is mounted in the cavity 38. The insert 44 has a conical flange 46 that engages the conical surface providing a bearing surface. The body 45 has an internal longitudinal threaded bore 48 with fine threads for receiving a pressure screw 50. The pressure screw 50 has a threaded body of exterior fine threads to mesh with the threaded bore 48. The pressure screw may be rotated to move a pointed end 54 of the pressure screw outward to engage the barrel 12 at the specific location to apply pressure to the barrel 12 to dampen the vibration. The pressure screw 50 includes a tool recess aperture 56 formed in the other end that may receive an "Allen" wrench for rotating the pressure screw to obtain the desired pressure of the pointed end against the barrel 12.

The vibration dampening device 36 includes a tool access aperture 58 formed in the insert 44 and in the forearm 14 to provide access to a tool (not shown) that may be inserted into the tool recess aperture 56 to rotate the pressure screw 50 within the body 45 to obtain the desired pressure against the barrel.

The vibration dampening device further includes a locking means 60 that includes a radial threaded aperture formed in the insert in communication with the threaded bore 48. A locking screw 62 is mounted in the radial aperture for engaging the pressure screw 50 to lock the pressure screw from any movement. The locking means 60 further includes a locking tool access aperture 64 that is formed in a side surface 22 of the forearm and extends inward in alignment with the locking screw 62 to enable a tool (not shown) such as an Allen wrench tool to be inserted to rotate the locking screw into and out of engagement with the pressure screw 50.

The vibration dampening device 36 may need to be adjusted depending upon the temperature and humidity when used to obtain the most accurate results. One can notice that a very small facial modification is made of the forearm 14 to receive the vibration dampening device 36. Only the tool access apertures 56 and 58 are visible on close inspection.

Figure 5:
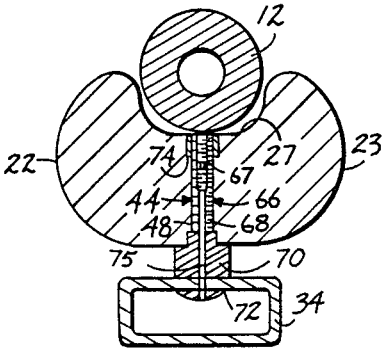
FIG. 5 is a cross-sectional view similar to FIG. 2 except showing another alternate embodiment of the barrel dampening device.

In an alternate embodiment illustrated in FIG. 5, the vibration dampening device 36 is combined with the rifle sling stud 32 to form a single unit. In an alternate embodiment, the insert 44 is in the form of a bolt 66 that is mounted in a cavity that extends through the forearm 14 as illustrated in FIG. 5. The bolt 66 has a threaded shaft 68 with an enlarged bolt head 70. The enlarged bolt head 70 has a rifle sling ring clip aperture 72 formed therein to receive the ring clip 34. The cavity 44 includes a counter bore adjacent the groove 27 for receiving a bolt nut 74. The bolt nut 74 receives the threaded shaft 68. The bolt 66 has a threaded bore formed therein to receive the pressure screw 67. A tool access aperture 75 extends through the enlarged bolt head 70 intersecting the rifle sling ring aperture 72 having communication with the threaded bore 48. A tool such as an "Allen" wrench may be inserted through the tool aperture 75 to rotate the pressure screw 50 in the threaded bore 48 of the bolt shaft 68.

Figure 4:
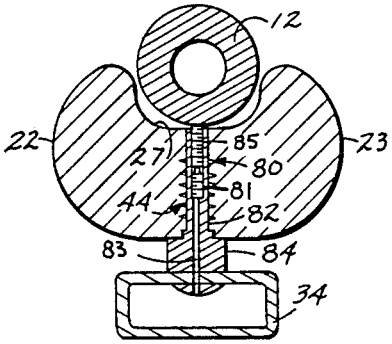
FIG. 4 is a cross-sectional view similar to FIG. 2 except showing an alternate embodiment of the barrel dampening device.

In a second alternate embodiment, the insert 44 may be in the form of a wood screw 80 that is illustrated in FIG. 4. The wood screw 80 includes a screw shaft 82 that is threaded into the cavity 38. The wood screw 80 includes a enlarged screw head 84 having a rifle sling aperture formed therein to receive the ring clip 34 of the rifle sling. The screw shaft has the threaded bore 81 formed therein with fine threads to receive the pressure screw 50. The wood screw 80 includes a tool access aperture 83 that extends through the enlarged screw head 84 intersecting the rifle sling aperture 86 to enable a tool to be inserted through the tool access aperture 83 to rotate the pressure screw 85 with respect to the screw shaft 82.

It should be noted that in each of the embodiments, the vibration dampening device is provided without materially modifying the forearm or to provide additional projecting elements along the lower profile surface 16. In the second and third embodiment illustrated in FIGS. 4 and 5, the vibration dampening device 36 is combined with the rifle sling stud 32 to form a single element. In the first embodiment, the insert 44 is mounted in the groove 27 with only small apertures 58 and 61 extending outward to the lower profile surface 16.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. In a rifle having a rifle action with a cantilevered barrel extending forward of the action for directing a bullet along a barrel axis;

said barrel being unconnected with respect to a stock forearm that extends forward beneath the barrel;

said stock forearm having an elongated stock body to an end with a lower profile surface enbling a rifleman to grip and point the rifle and an upper profile surface having a longitudinal groove formed therein for receiving the barrel therein without the barrel engaging the upper profile surface;

said elongated stock body having a cavity formed in the upper profile surface beneath the barrel inward of the stock body end with a cavity bore axis normal to and vertically intersecting the barrel axis with a cavity opening facing the barrel;

vibration dampening device mounted in the cavity for engaging the barrel spaced forward of the action to dampen any vibration of the barrel as the bullet travels through the barrel;

said vibration dampening device having a single insert placed in the cavity in which the insert has an axial bore formed therein with internal fine threads;

a fine threaded pressure screw threadably mounted in the axial bore for axial movement therein;

said pressure screw having an upper end projecting upward engaging the barrel to support the barrel forward of the rifle action; and said pressure screw having a lower end with a tool receiving aperture for enabling a tool to be inserted therein to rotate the pressure screw and adjust the pressure of the upper end against the barrel.

2. In a rifle as defined in claim 1 wherein the cavity has a beveled counterbore formed therein communicating with the cavity opening defining a countersunk conical wall and wherein the insert includes a frustroconical surface for engaging the countersunk wall to provide a bearing surface.

3. In a rifle as defined in claim 1 wherein the forearm has a tool access aperture formed therein extending between the lower profile surface and the cavity coaxial with the cavity to enable a tool to be inserted through the tool access aperture and into the tool receiving aperture in the pressure screw to rotate the pressure screw and adjust the pressure of the screw against the barrel.

4. In a rifle as defined in claim 1 wherein the vibration dampening device includes a locking means for locking the pressure screw in place once the proper barrel pressure has been obtained.

5. In a rifle as defined in claim 4 wherein the locking means includes a threaded radial aperture formed in the insert normal to the cavity access and a locking screw mounted in the threaded radial aperture for engaging the pressure screw to lock the pressure screw in place.

6. In a rifle as defined in claim 5 wherein the forearm has a locking screw access aperture formed therethrough to enable a lock screw tool to be inserted therethrough to engage an rotate the locking screw.

7. In a rifle as defined in claim 1 wherein the cavity extends through the forearm from the lower profile surface to the upper profile surface with a counterbore formed in the cavity communicating with the upper profile surface, and wherein the insert includes a threaded bolt with a bolt head engaging the lower profile surface and a threaded bolt nut mounted in the counterbore to lock the bolt in the cavity; said bolt having a rifle sling aperture formed therein to receive a rifle sling clip; said bolt having the axial bore formed therein to receive the pressure screw.

8. In a rifle as defined in claim 7 wherein the bolt includes a tool access aperture formed therein extending through the bolt head and intersecting the rifle sling aperture to enable a tool to be inserted through the tool access aperture to rotate the pressure screw.

9. In a rifle as defined in claim 1 wherein the cavity extends through the forearm from the lower profile surface to the upper profile surface and wherein the insert includes a threaded wood screw with an enlarged wood screw head engaging the lower profile surface; said wood screw head having a rifle sling aperture formed therein for receiving a rifle sling clip.

10. In a rifle as defined in claim 9 wherein the wood screw includes a tool access aperture formed therein extending through the enlarged wood head and intersecting the rifle sling aperture to enable a tool to be inserted through the tool access aperture to rotate the pressure screw.

* * * * *